US005694377A

United States Patent [19]

Kushnick

[11] Patent Number: 5,694,377

[45] Date of Patent: Dec. 2, 1997

[54] DIFFERENTIAL TIME INTERPOLATOR

[75] Inventor: Eric B. Kushnick, Ashland, Mass.

[73] Assignee: LTX Corporation, Westwood, Mass.

[21] Appl. No.: 633,071

[22] Filed: Apr. 16, 1996

[51] Int. Cl.[6] ..... G04F 8/00

[52] U.S. Cl. ..... 368/120

[58] Field of Search ..... 368/113–120

[56] References Cited

U.S. PATENT DOCUMENTS

| | | | |
|---|---|---|---|
| 2,877,413 | 3/1959 | Muehlner . | |
| 3,204,180 | 8/1965 | Bray et al. . | |
| 3,264,454 | 8/1966 | Davis et al. . | |
| 3,305,785 | 2/1967 | Carrol, Jr. . | |
| 3,688,194 | 8/1972 | Furois . | |
| 4,433,919 | 2/1984 | Hoppe . | |
| 4,439,046 | 3/1984 | Hoppe . | |
| 4,855,970 | 8/1989 | Hayashi et al. . | |
| 4,875,201 | 10/1989 | Dalzell | 368/120 |
| 4,982,387 | 1/1991 | Trent | 368/117 |

*Primary Examiner*—Bernard Roskoski
*Attorney, Agent, or Firm*—Lappin & Kusmer LLP

[57] ABSTRACT

The disclosed apparatus includes first and second delay lines, the first delay line having an input tap and a set of n output taps $F_1, F_2, \ldots F_n$, and the second delay line having an input tap and a set of n output taps $S_1, S_2, \ldots S_n$, and each of the output taps has an associated delay interval. A first signal representative of a first event is applied to the input tap of the first delay line, and a second signal representative of a second event is applied to the input tap of the second delay line. The disclosed apparatus further includes a set of n latches $L_1, L_2, \ldots L_n$, and a set of n delay units $D_1, D_2, \ldots D_n$. The output signals generated by taps $F_i$ and $S_i$ are applied to a first input terminal and a second input terminal, respectively, of latch $L_i$. Each of the latches generates a latch signal by using one of the signals applied to its first and second input terminals to latch the signal applied to the other of its first and second input terminals. The latch signal generated by latch $L_i$ is applied to the delay unit $D_i$. Each of the delay units delays its latch signal by an associated latch delay interval and thereby generates a code signal. The associated latch delay interval of delay unit $D_i$ is at least as large as a difference between the output delay intervals associated with the nth and ith output taps $S_n$ and $S_i$ of the second delay line.

30 Claims, 4 Drawing Sheets

DIFFERENTIAL TIME INTERPOLATOR

CROSS-REFERENCE TO RELATED APPLICATIONS

This application is related to U.S. patent application Ser. No. 08/633,172, entitled Improved Test System, (Attorney Docket No. LTXL-111) assigned to the present assignee, and filed concurrently with the present application.

BACKGROUND OF THE DISCLOSURE

The present invention relates generally to devices for accurately measuring the duration of a time interval. More particularly, the present invention relates to devices for measuring the durations of a series of closely spaced time intervals.

When measuring the duration of a time interval, it is a common practice to apply a clock signal characterized by a known, relatively high, oscillation frequency $f_c$ and a corresponding period $T_c$ to a counter and to count the number of complete periods $T_c$ of the dock signal occurring during the interval. However, the resolution of such a measurement is of course limited by the size of the clock period $T_c$. It is also known to use a device, referred to as a "time interpolator", which measures time intervals shorter than a single clock period $T_c$, to increase the resolution of such timing measurements. A time interval measuring system, or an event time stamper, may therefore comprise a counter for providing a relatively coarse measurement of the duration of a time interval in terms of an integer number of clock periods $T_c$, and a time interpolator for providing an accurate measurement of the "remainder" of the time interval that occurs during a fractional portion of a single clock period $T_c$. In such a system, the counter and the time interpolator may be thought of as supplying the most significant bits and the least significant bits, respectively, of the timing measurement.

There are many applications for an event time stamper that require a timing measurement having a resolution much finer than that of a single clock period. For example, certain well known radar systems require high resolution measurements of the time interval between transmission of a radar signal and the time of arrival of a reflected radar signal to enable tracking of moving targets, such as a rapidly accelerating aircraft. As another example, semiconductor test equipment for testing high speed integrated circuits must accurately measure the times of arrival of signals generated by a device under test (DUT) to properly evaluate the DUT. These systems, and many others, have a need for an event time stamper that includes a time interpolator for providing the least significant bits of a timing measurement.

One prior art form of time interpolator is implemented as an analog circuit that uses a capacitor to store a charge that linearly increases with time for a duration related to a time interval, so that the final capacitor voltage is indicative of the duration of the interval. However, such circuits are only of limited utility since at relatively high clock frequencies (e.g., near 1 GHz) it is extremely difficult to design a circuit that provides a linearly increasing voltage (or charge) signal that starts and stops ramping within a fraction of a clock period. Such a circuit requires a very high analog signal bandwidth to maintain the fidelity of the signal and this is difficult to achieve in practice. Further, devices for measuring the voltage (or charge) stored in a capacitor are relatively slow and therefore unacceptably limit the speed of such circuits.

U.S. Pat. No. 4,439,046, issued to Hoppe on Mar. 27, 1984, discloses another type of time interpolator (referred to hereinafter as the "Hoppe interpolator") that includes a set of latch circuits and a tapped delay line having a total delay that is at least as long as a single clock period. A clock signal is applied to the input tap of the delay line and the delayed clock signals generated at the output taps are applied to respective ones of the clock inputs of the latch circuits. A stop signal containing a signal edge (e.g., a falling edge transition from a "one" state to a "zero" state), the location of which indicates the end of a time interval of unknown length, is applied to the set inputs of all the latch circuits. Each of the latch circuits samples the stop signal using its own respectively delayed clock signal, and the set of latch circuits thereby generates a set of output signals indicative of the location of the signal edge. These output signals are applied to a read only memory (ROM) which decodes the output signals and generates an indication of the duration of the interval.

The Hoppe interpolator has only limited utility since the resolution of its timing measurements is determined by the delay between adjacent output taps of the delay line. For example, for a desired resolution of 50 ps the delay line would have to provide output taps spaced apart by 50 ps, and such delay lines are extremely difficult to realize in practice. Further, for ideal operation of the Hoppe interpolator, there must be no relative delay between the signal paths that apply the stop signal to the latch circuits. However, this is also difficult to achieve in practice, and any such relative delay significantly decreases the accuracy of the Hoppe interpolator when it is operated at relatively high clock frequencies. Therefore, the Hoppe interpolator provides only limited resolution and is only operative at relatively low frequencies.

U.S. Pat. No. 4,433,919, issued on Feb. 8, 1984 also to Hoppe, discloses a differential time interpolator (referred to hereinafter as the "Hoppe differential interpolator") that alleviates some of the problems associated with the Hoppe interpolator. The Hoppe differential interpolator receives two input signals, each containing a signal edge, and generates an output signal indicative of the relative timing of the two signal edges. The Hoppe differential interpolator includes two tapped delay lines and a set of n set-reset type flip flop circuits. One of the delay lines has n output taps $T_{11}$, $T_{12}, \ldots, T_{1n}$, and the other delay line has n corresponding output taps $T_{21}, T_{22}, \ldots, T_{2n}$. The delay lines are configured so that the differential delay $\Delta T$ between corresponding taps of the two delay lines is described by the formula shown in Equation (1)

$$\Delta T=[D_{1i}-D_{1(i-1)}]-[D_{2i}-D_{2(i-1)}] \quad (1)$$

in which $D_{ji}$ equals the delay associated with output tap $T_{ji}$. One of the input signals is applied to the input tap of one of the delay lines, the output taps of which are coupled to respective ones of the set inputs of the flip flop circuits. The other input signal is applied to the input tap of the other delay line, the output taps of which are coupled to respective ones of the reset inputs of the flip flop circuits. The flip flop circuits then generate a set of output signals representative of the time interval between the two signal edges.

The resolution of the timing measurement provided by the Hoppe differential interpolator is equal to $\Delta T$, so in principle a resolution of 50 ps may be achieved by, for example, structuring the first delay line so that the delay between adjacent taps $D_{1i}$ and $D_{1(i-1)}$ is 300 ps and by structuring the second delay line so that the delay between adjacent taps $D_{2i}$ and $D_{2(i-1)}$ is equal to 250 ps. Since such delay lines are more readily realizable than delay lines having output taps spaced apart 50 ps, the resolution of the timing measurement provided by the Hoppe differential interpolator is improved over that of the Hoppe interpolator. However, the Hoppe differential interpolator still has significant disadvantages.

The Hoppe differential interpolator uses delay lines having n output taps, and n must be large enough so that n times $\Delta T$ is at least as long as a single clock period. For high resolution measurements, $\Delta T$ is generally a relatively small fraction of the delay between adjacent output taps (e.g., $D_{12}$ minus $D_{11}$), so the total delay of the delay lines is much longer than a single clock period. However, once two input signals containing signal edges occurring at unknown times have been applied to the Hoppe differential interpolator, these signals must be allowed to completely propagate through the delay lines before new input signals may be applied to the interpolator. Therefore, the Hoppe differential interpolator has an inconveniently long "restart" or "retrigger" time, where the "retrigger" time is defined as the interval one must wait after applying unknown signals to the interpolator before a new set of unknown signals may be applied. In the Hoppe differential interpolator, the retrigger time is equal to the total length of the delay lines which is generally much longer than a single clock period.

It is therefore an object of the invention to provide an improved time interpolator that provides high resolution measurements, is operative at relatively high clock frequencies, and has a relatively short retrigger time.

Other objects and advantages of the present invention will become apparent upon consideration of the appended drawings and description thereof.

SUMMARY OF THE INVENTION

The foregoing and other objects are achieved by the invention which in one aspect comprises an apparatus for measuring a time interval between a first event and a second event. The apparatus includes first and second delay lines, the first delay line having an input tap $F_{in}$ and a set of n output taps $F_1, F_2, \ldots F_n$, and the second delay line having an input tap $S_{in}$ and a set of n output taps $S_1, S_2, \ldots S_n$, and each of the output taps has an associated delay interval. A first signal representative of the first event is applied to the input tap $F_{in}$ of the first delay line, and a second signal representative of the second event is applied to the input tap $S_{in}$ of the second delay line. Each of the output taps generates an output signal representative of the signal applied to its respective input tap after being delayed by its associated output delay interval.

The apparatus also includes a set of n latches $L_1, L_2, \ldots L_n$, and a set of n delay units $D_1, D_2, \ldots D_n$. The latches may be flip flops or other register devices, and each of the latches has first and second input terminals. The first and second input terminals of every latch are coupled to receive the output signals generated at corresponding ones of the output taps of the first and second delay lines, respectively. The output signal generated at tap $F_i$ is applied to the first input terminal of latch $L_i$ and the output signal generated at tap $S_i$ is applied to the second input terminal of latch $L_i$ for all i from one to n. Each of the latches uses one of the signals received at its first and second input terminals to latch the other of the signals received at its first and second input terminals and thereby generates a latch signal. The latches may generate the latch signals by, for example, using the rising edge transitions of the signals applied to their second input terminals to latch, or sample, the signals applied to their first input terminals.

The latch signals generated by the latches are applied to corresponding ones of the delay units, so that the latch signal generated by latch $L_i$ is applied to delay unit $D_i$ for all i from one to n. Each of the delay units has an associated latch delay interval, and the associated latch delay interval of delay unit $D_i$ is at least as large as a difference between the output delay intervals associated with the nth and ith output taps $S_n$ and $S_i$ of the second delay line for all i from one to n. Each of the delay units $D_i$ generates a code signal representative of the signal received from its corresponding latch $L_i$ after being delayed by its associated latch delay interval for all i from one to n.

The apparatus may also include a decoder, such as a read only memory (ROM), that receives the code signals and generates therefrom a time stamp signal representative of the duration of the interval between the first and second events.

The first delay line may be structured so that the difference between the output delay intervals of any two consecutive output taps $F_i$ and $F_{(i-1)}$ is equal to a first unit delay. Similarly, the second delay line may be structured so that the difference between the output delay intervals of any two consecutive output taps $S_i$ and $S_{(i-1)}$ may be equal to a second unit delay, and the second unit delay may be less than the first unit delay.

The apparatus may be implemented using a single integrated circuit, and the delay lines may be implemented using transmission lines or sets of serially cascaded delay elements.

In another aspect, the invention provides an event time stamper including a counter for counting the number of complete clock periods of a clock signal occurring during an interval, and an apparatus of the type described above for measuring the duration of the remainder of the interval that occurs during a fraction of a single clock period.

BRIEF DESCRIPTION OF DRAWINGS

The foregoing and other objects of this invention, the various features thereof, as well as the invention itself, may be more fully understood from the following description, when read together with the accompanying drawings in which.

Like numbered elements in each FIGURE represent the same or similar elements.

DESCRIPTION OF THE PREFERRED EMBODIMENTS

Figure 1:
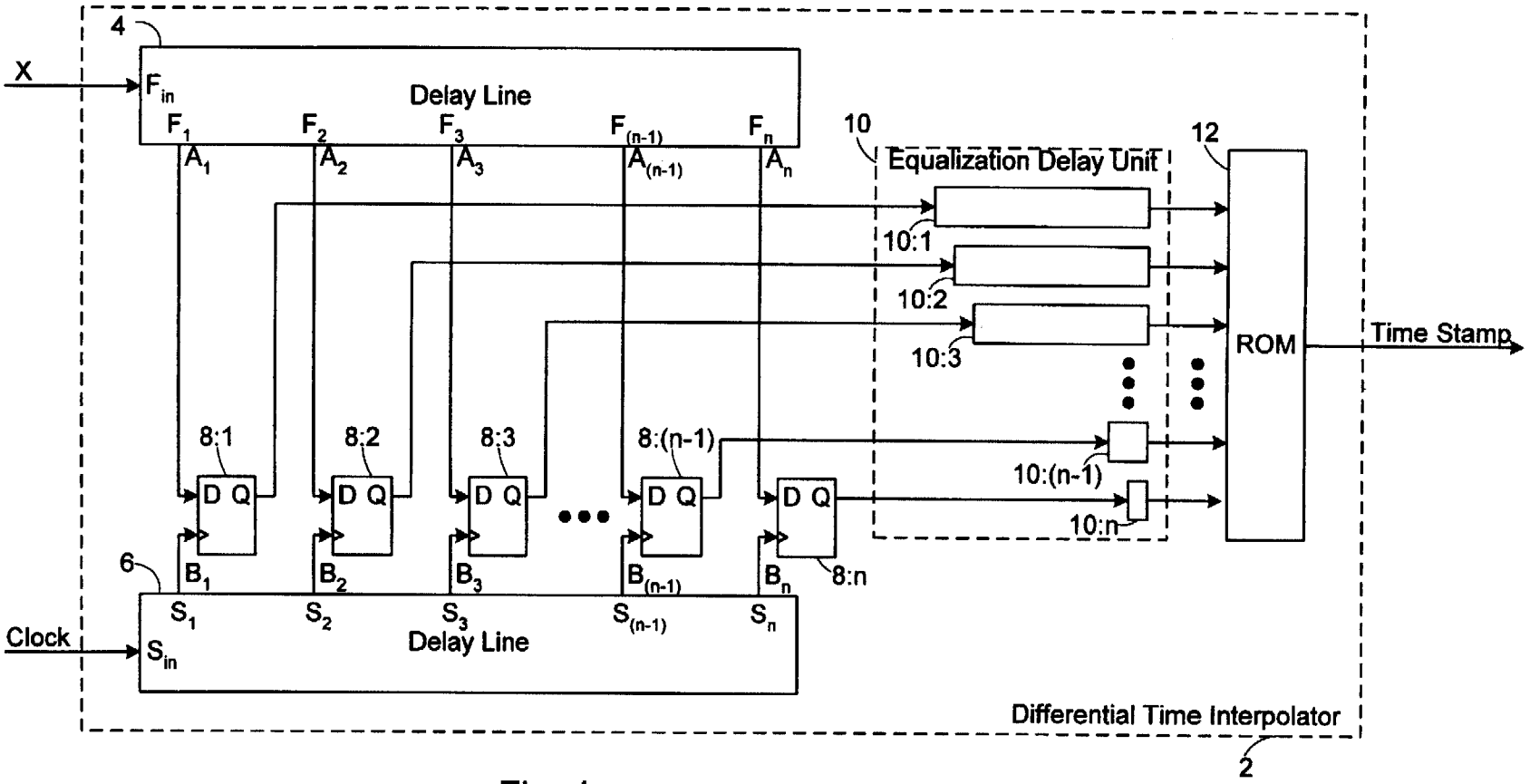
FIG. 1 shows a block diagram of a differential time interpolator constructed according to the invention.

FIG. 1 shows a block diagram of a preferred embodiment of an improved differential time interpolator 2 constructed in accordance with the present invention. Interpolator 2 includes two tapped delay lines 4 and 6 each having an input tap $F_{in}$ and $S_{in}$, respectively, and a set of n output taps $F_1$–$F_n$, and $S_1$–$S_n$, respectively; a set of n D type flip flops 8:1–8:n each having a D input terminal, a clock input terminal, and a Q output terminal; an equalization delay unit 10 including n individual delay units or delay lines 10:1–10:n each having an input terminal and an output terminal; and a read only memory 12.

In operation interpolator 2 receives an unknown signal x and a periodic clock signal that is characterized by a clock frequency $f_c$ and a clock period $T_c$. The unknown signal x may have a signal edge (e.g., a rising edge transition or a falling edge transition) that occurs at an unknown time within a single clock period $T_c$. The interpolator 2 generates a time stamp signal representative of the occurrence time of the unknown signal edge. As will be discussed in greater detail below, interpolator 2 provides timing measurements having improved resolution, and further, interpolator 2 has a reduced retrigger time, all compared to prior art configurations.

Delay line 4 receives the unknown signal x at its input tap $F_{in}$ and generates therefrom a set of n output signals $A_1$–$A_n$ at its n output taps $F_1$–$F_n$. The n output signals $A_1$–$A_n$ are applied to respective ones of the D input terminals of flip flops 8:1–8:n (i.e., $A_i$ is applied to the D input terminal of flip flop 8:i, for all i from one to n). Delay line 4 is characterized by a unit delay $T_A$ and generates its ith output signal $A_i$ so that it is representative of the unknown signal x after being delayed by i unit delays (i.e., i times $T_A$), for all i from one to n.

Delay line 6 receives the clock signal at its input tap $S_{in}$ and generates therefrom a set of n output signals $B_1$–$B_n$ at its n output taps $S_1$–$S_n$. The n output signals $B_1$–$B_n$ are applied to respective ones of the clock input terminals of flip flops 8:1–8:n (i.e., $B_1$ is applied to the clock input terminal of flip flop 8:i, for all i from one to n). Delay line 6 is characterized by a unit delay $T_B$ and generates its ith output signal $B_i$ so that it is representative of the clock signal after being delayed by i unit delays (i.e., i times $T_B$), for all i from one to n.

The ith flip flop 8:i samples the delayed version of the unknown signal x applied to its D input terminal (i.e., $A_i$) using the delayed version of the clock signal applied to its clock input terminal (i.e., $B_i$) and thereby generates an output signal at its Q output terminal. The output signals generated at the Q output terminals of the flip flops 8:1–8:n are applied to respective ones of the input terminals of the delay lines 10:1–10:n of equalization delay unit 10 (i.e., the output signal generated at the Q output terminal of the ith flip flop 8:i is applied to the input terminal of the ith delay line 10:i in unit 10, for all i from one to n).

The ith delay line 10:i in unit 10 generates an output signal at its output terminal that is representative of the signal applied to its input terminal after being delayed by n minus i plus one unit delays $T_B$ of delay line 6 (i.e., $[n-i+1]T_B$), for all i from one to n. So the first delay line 10:1 in unit 10 provides a delay equal to n unit delays $T_B$, and the last delay line 10:n in unit 10 provides a delay equal to one unit delay $T_B$.

All the output signals generated by equalization delay unit 10 are applied to the input terminals of ROM 12 which generates therefrom the time stamp signal.

Figure 2A:
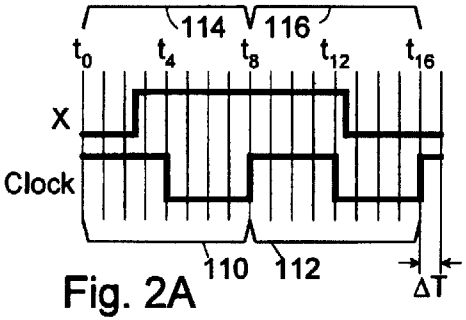
FIGS. 2A–I show timing diagrams illustrating the performance of the differential time interpolator shown in FIG. 1.

FIGS. 2A–I show timing diagrams that illustrate the operation a specific embodiment of interpolator 2 in which n is equal to eight (so delay lines 4 and 6 each have eight output taps, and interpolator 2 includes eight flip flops 8:1–8:8), and in which the unit delay $T_A$ of delay line 4 is equal to four times a quantity ΔT, and in which the unit delay $T_B$ of delay line 6 is equal to three times ΔT. FIG. 2A shows a graph of the unknown signal x and the clock signal for two periods $T_c$ of the clock signal, the first period being indicated at brackets 110, 114, and the second period being indicated at brackets 112, 116. Each clock period has been divided into eight equally sized intervals of ΔT, the first period beginning at time $t_0$ and ending at time $t_8$ and the second period beginning at time $t_8$ and ending at time $t_{16}$. The unknown signal x has a rising edge transition that occurs during the third interval (of ΔT) of the first clock period (i.e., between $t_2$ and $t_3$) and a falling edge transition that occurs during the fifth interval of the second clock period (i.e., between $t_{12}$ and $t_{13}$).

FIGS. 2B–2I illustrate the signals $A_1$–$A_8$ and $B_1$–$B_8$ generated by delay lines 4 and 6, respectively. Since the unit delay $T_A$ of delay line 4 is greater than the unit delay $T_B$ of delay line 6, there is a timing offset between each signal $A_i$ and its corresponding signal $B_i$ and these offsets are indicated in FIGS. 2B–2I by the relative locations of brackets 110, 112, 114, 116. In FIGS. 2B–2I, brackets 110 and 112 indicate the portions of the $B_i$ signal that correspond to the portions of the clock signal indicated by brackets 110 and 112, respectively, shown in FIG. 2A. Similarly, in FIGS. 2B–2I, brackets 114 and 116 indicate the portions of the $A_i$ signal that correspond to the portions of the unknown signal x indicated by brackets 114 and 116, respectively, shown in FIG. 2A. In each of the FIGS. 2A–2I, the brackets 110, 112 are positioned differently relative to brackets 114, 116, and this difference in relative position results from the difference of ΔT between the unit delays $T_A$ and $T_B$.

Figure 2B:
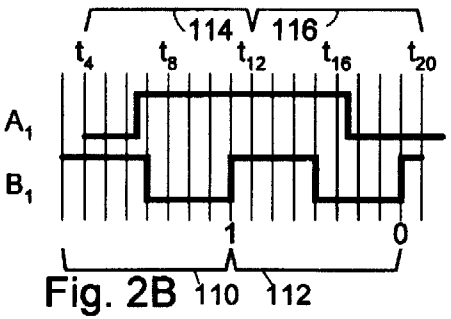
Figure 2C:
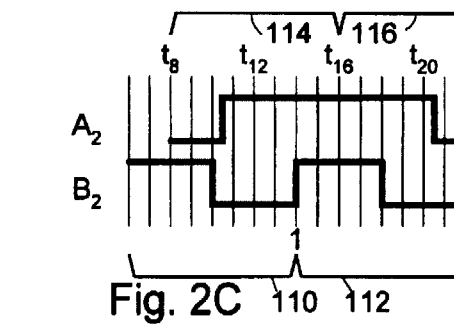
Figure 2D:
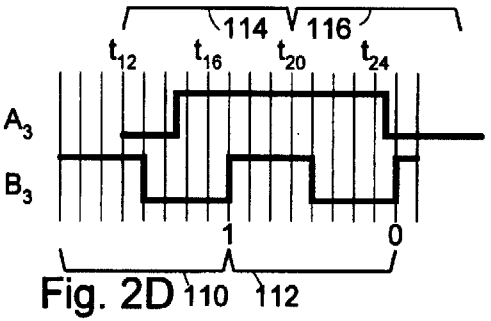
Figure 2E:
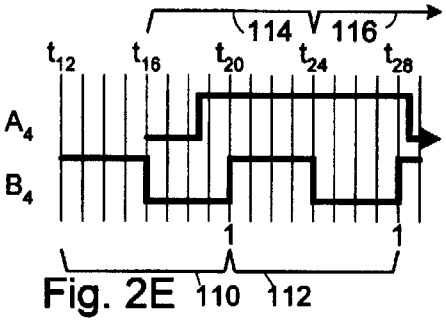
Figure 2F:
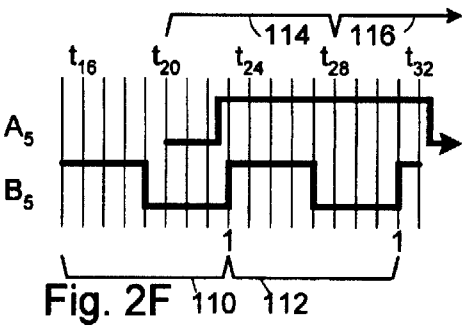
Figure 2G:
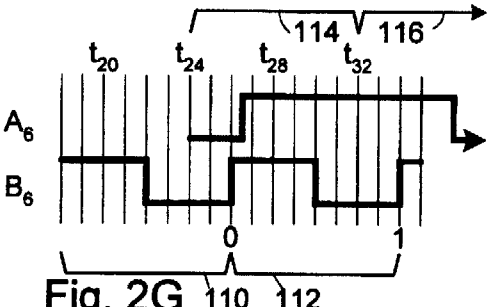
Figure 2H:
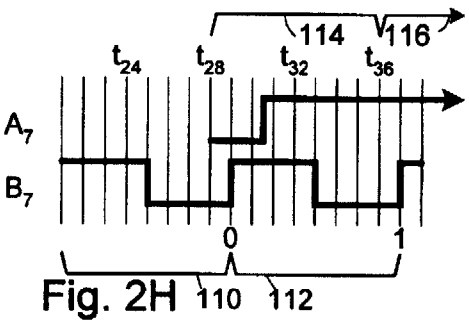
Figure 2I:
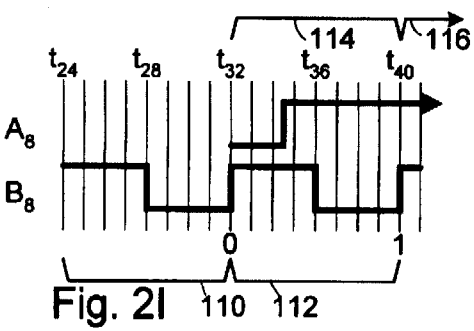

The eight flip flops 8:1–8:8 generate eight different samples of the unknown signal for every clock period. This is illustrated in FIGS. 2B–2I, by the location of the rising edge transitions in the $B_i$ signals relative to the locations of brackets 114 and 116. As shown in FIG. 2B, the first rising edge transition of the $B_1$ signal (which corresponds to the rising edge transition of the clock signal occurring at the end of the first dock period at time $t_8$ as shown in FIG. 2A) occurs ΔT before the end of bracket 114, and as shown in FIG. 2C, the first rising edge transition of the $B_2$ signal occurs 2ΔT before the end of bracket 114. This trend of advancing by ΔT continues and as shown in FIG. 2I, the first rising edge transition of the signal $B_8$ occurs at the beginning of bracket 114.

In the illustrated embodiment, the flip flops 8:1–8:n are rising edge sensitive. Accordingly, each of the flip flops 8:i uses the rising edge transitions of the $B_i$ signal applied to its clock input terminal to sample the state of the $A_i$ signal applied to its D input terminal, and the flip flops 8:1–8:n thereby generate eight equally spaced (i.e., spaced apart by a relative delay of ΔT) samples of the unknown signal for every clock period, and the resolution of interpolator 2 is therefore equal to ΔT.

The eight samples generated by flip flops 8:8–8:1 in response to the rising edge transition of the clock signal occurring at time $t_8$ (i.e., the samples generated by flip flop 8:8 at time $t_{32}$, and by flip flop 8:7 at time $t_{29}$, and by flip flop 8:6 at time $t_{26}$, and by flip flop 8:5 at time $t_{23}$, and by flip flop 8:4 at time $t_{20}$, and by flip flop 8:3 at time $t_{17}$, and by flip flop 8:2 at time $t_{14}$, and by flip flop 8:1 at time $t_{11}$) may be grouped into an eight bit vector, and as indicated in FIGS. 2B–2I by the numbers underneath the first rising edge of the $B_i$ signals this vector equals "0001 1111". Similarly, the samples generated by flip flops 8:n–8:1 in response to the second rising edge transition of the clock signal may be grouped into an eight bit vector equal to "1111 1000".

The first vector "0001 1111" is indicative of the rising edge transition of the unknown signal occurring during the third interval of the first clock period, and the second vector "1111 1000" is indicative of the falling edge transition of the unknown signal occurring during the fifth interval of the second clock period. In general, grouping the samples generated by all the flip flops 8:1–8:n in response to a single rising edge transition of the clock, signal generates a vector that is indicative of whether a transition of the unknown signal occurred during the clock period preceding that rising edge and of the location of the transition if one occurred. However, the flip flops 8:1–8:n do not generate all the bits of this vector at the same time. In fact, as shown in FIGS. 2B and 21, by the time flip flop 8:8 generates the last bit of the first vector at time $t_{32}$ the first bit of the first vector is no longer available at flip flop 8:1, since the signal at the Q output terminal of flip flop 8:1 may have changed states at time $t_{19}$ in response to the second rising edge of the $B_1$ signal.

All the output signals generated by flip flops 8:1–8:n are applied to equalization delay unit 10 (shown in FIG. 1) which provides an appropriate amount of delay to each signal so as to "line up" all the bits of each vector. As stated above, each of the n delay lines 10:i in unit 10 provides a delay equal to $(n-i+1)T_B$, and this amount of delay insures that every bit of a vector generated by unit 10 corresponds to the same rising edge of the clock signal. So, unit 10 generates n-bit output vectors, and each of these vectors corresponds to a single clock period and is representative of the location of a transition of the unknown signal (if one occurred) occurring during its corresponding clock period. The vectors generated by equalization delay unit 10 are applied to the input of ROM 12 which generates therefrom a time stamp signal that is representative of the locations of transitions of the unknown signal.

Since the last bit of each vector (i.e., the bit provided by flip flop 8:n) is not available until after a delay of $nT_B$ following the end of its corresponding clock period, interpolator 2 may be said to have a measurement delay of $nT_B$. That is, at any given time, the time stamp signal generated by ROM 12 is representative of events that occurred previously by an interval at least as long as $nT_B$. Although interpolator 2 has this associated measurement delay, interpolator 2 is able to accept a new transition of the unknown signal every clock period. So the retrigger time of interpolator 2 is equal to the clock period $T_c$. Prior art interpolators, such as the Hoppe differential interpolator, have retrigger times that are at least as long as their measurement delay, and normally, the measurement delay is on the order of many clock periods. Accordingly, differential interpolator 2 provides a significant advantage in that it is able to accept a new transition of the unknown signal in every clock period.

Figure 3:
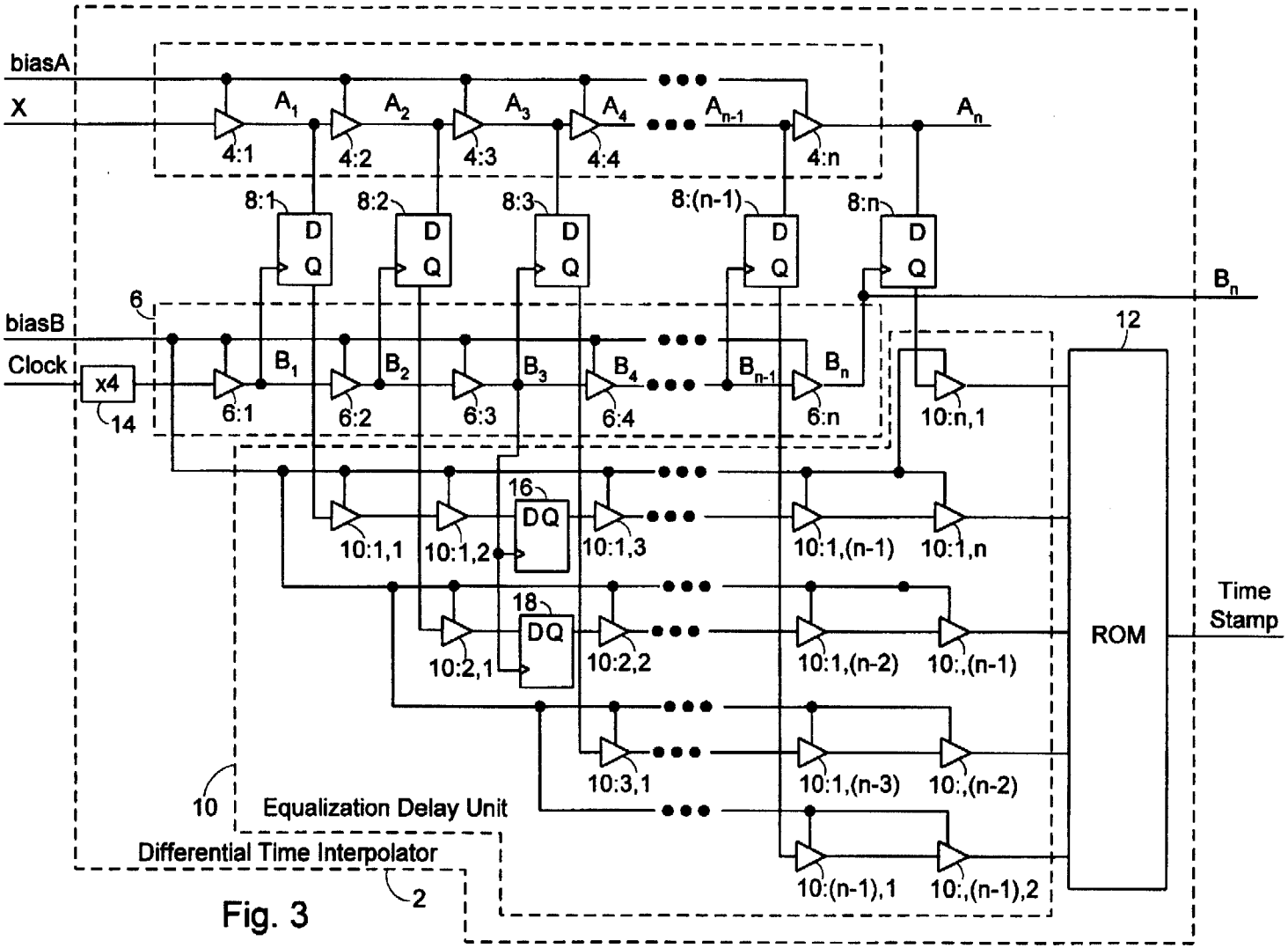
FIG. 3 shows a block diagram of a preferred integrated circuit embodiment of the differential time interpolator shown in FIG. 1.

Interpolator 2 is preferably implemented using a single integrated circuit chip. FIG. 3 shows a block diagram of one such preferred single chip embodiment of interpolator 2. In addition to the unknown and clock signals, this embodiment of interpolator 2 also receives a biasA signal and biasB signal. In this embodiment, delay line 4 is a transmission line that includes a set of n serially cascaded delay elements 4:1–4:n, and similarly, delay line 6 is a transmission line that includes a set of n serially cascaded delay elements 6:1–6:n. Each of the delay elements 4:1–4:n and 6:1–6:n are implemented using bipolar transistor gates having an input terminal, an output terminal, and a bias terminal, and are configured so that the propagation delay from the input terminal to the output terminal is a function of the current applied to the bias terminal.

The unknown signal x is applied to the input terminal of the first delay element 4:1 and the signal biasA is applied to the bias terminal of each of the delay elements 4:1–4:n of delay line 4. The signal generated at the output terminal of each of the delay elements 4:i is applied to the input terminal of the next delay element 4:(i+1) for all i from one to (n–1). Each of the elements 4:i generates a respective one of the $A_i$ signals, for all i from one to n, and the nth signal $A_n$ is coupled to an output pin of interpolator 2.

A frequency multiplier 14 receives the clock signal and generates therefrom a high frequency clock signal. The high frequency clock signal is applied to the input terminal of the first delay element 6:1 of delay line 6 and the signal biasB is applied to the bias terminal of each of the delay elements 6:1–6:n of delay line 6. The signal generated at the output terminal of each of the delay elements 6:i is applied to the input terminal of the next delay element 6:(i+1) for all i from one to (n–1). Each of the elements 6:i generates a respective one of the $B_i$ signals, for all i from one to n, and the nth signal $B_n$ is coupled to an output pin of interpolator 2.

The signals $A_1$–$A_n$ generated by delay line 4 are applied to respective ones of the D input terminals of flip flops 8:1–8:n. Similarly, the signals $B_1$–$B_n$ generated by delay line 6 are applied to respective ones of the clock input terminals of flip flops 8:1–8:n. Each of the flip flop circuits uses the signal applied to its clock input terminal to sample the signal applied to its D input terminal and thereby generates an output signal at its Q output terminal. The n output signals generated by flip flops 8:1–8:n are applied to input terminals of equalization delay unit 10. The latter generates therefrom n output signals that are applied to ROM 12 which in turn generates therefrom the time stamp signal.

The total delay $TotalD_A$ provided by delay line 4 is equal to the sum of all the unit delays provided by the delay elements 4:1–4:n, and coupling the output terminal of the last delay element 4:n in delay line 4 to an output pin of interpolator 2 facilitates the measurement of the total delay $TotalD_A$. Similarly, the total delay $TotalD_B$ provided by delay line 6 is equal to the sum of all the unit delays provided by the delay elements 6:1–6:n, and coupling the output terminal of the last delay element 6:n in delay line 6 to an output pin of interpolator 2 facilitates the measurement of the total delay $TotalD_B$. Since the biasA signal is applied to the bias terminals of all the delay elements of delay line 4, and since there tends to be very little performance variation among similar components on the same integrated circuit, the unit delays provided by the elements 4:1–4:n are all substantially equal to $T_A$, and similarly, since the biasB signal is applied to all the delay elements of delay line 6, the unit delays provided by elements 6:1–6:n are all substantially equal to $T_B$. The unit delays $T_A$ and $T_B$ are therefore substantially equal to the total delays $TotalD_A$ and $TotalD_B$, respectively, divided by n. So, the unit delays $T_A$ and $T_B$ may be measured by measuring the total delays $TotalD_A$ and $TotalD_B$, respectively, and the unit delays $T_A$ and $T_B$ may be selected by appropriately adjusting the current levels of the input signals biasA and biasB, respectively.

Equalization delay unit 10 is implemented using a set of delay elements that are substantially identical to the elements used in delay lines 4, 6. Delay line 10:1 is implemented using a set of n serially cascaded delay elements 10:1,1–10:1,n, and in general, delay line 10:i is implemented using a set of (n–i+1) serially cascaded delay elements 10:i,1–10:i,(n–i+1). The bias input terminals of all the delay elements in unit 10 are coupled to receive the biasB signal. In certain embodiments of equalization delay unit 10 it may be preferable to include some clocked registers interposed between some of the adjacent delay elements as is indicated generally in FIG. 3 by flip flop elements 16 and 18. As those skilled in the art will appreciate, inclusion of such clocked registers may be useful to compensate for any variations between the delays provided by individual delay elements and may thereby insure that unit 10 generates every bit of every vector in a synchronous fashion.

As shown in FIG. 3, every delay line in equalization delay unit 10 provides an extra unit of delay $T_B$. That is, the signal generated at the Q output terminal of flip flop 8:n may be applied directly to ROM 12 rather than to delay unit 10:n,1, and similarly, one delay unit may be eliminated from each of the other delay lines in unit 10. When these extra delays are eliminated, delay line 10:i provides (n–i) unit delays $T_B$ rather than (n–i+1) unit delays for all i from one to n. Elimination of these extra delay elements has the advantage of reducing the measurement delay of interpolator 2 by one unit delay $T_B$, however, those skilled in the art will appreciate that in certain implementations of interpolator 2 it may be preferable to include these extra delays to provide a buffer between flip flop 8:n and ROM 12. Inclusion of extra delays in unit 10 does not disturb the alignment of the vectors applied to ROM 12 as long as the same number of extra delays are provided in each of the delay lines in unit 10.

In one preferred embodiment, interpolator 2 is configured to receive a 1.6 GHz clock signal, and $T_A$ and $T_B$ are chosen so that interpolator 2 provides timing measurements having a resolution of 10 ps, and n is equal to 64. One preferred choice for the unit delays is to set $T_A$ equal to 160 ps, and $T_B$ equal to 150 ps, although those skilled in the art will appreciate that there is a relatively large degree of flexibility in this choice.

The unit delays $T_A$ and $T_B$ are preferably chosen to be as small as is practical for the relevant technology used to implement interpolator 2, since reducing the unit delays tends to reduce any variations in the amount of delay actually provided by the delay elements and thereby increases the accuracy of interpolator 2. In general, the power demand of a delay element (or the amount of current applied to the bias terminal of a delay element) increases as the delay provided by the element decreases, so decreasing the unit delays normally comes at the cost of increased power demands, and in any practical design of interpolator 2 the need for accuracy is preferably balanced against the corresponding power demands.

When using a relatively high frequency clock signal, such as 1.6 GHz, it may be preferable for interpolator 2 to receive a lower frequency clock signal and to include frequency multiplier 14 for generating the high frequency clock signal from the lower frequency clock signal. For example, a 400 MHz clock signal may be applied to interpolator 2 and this signal may be received by frequency multiplier 14 which may be implemented, for example, as a times four multiplier. So in this embodiment, frequency multiplier 14 receives a 400 MHz clock signal and generates therefrom a 1.6 GHz clock signal and applies this signal to delay line 6. In other embodiments, multiplier 14 may increase or decrease the frequency by other factors, and in still other embodiments, multiplier 14 may be eliminated so that interpolator 2 receives the high frequency clock signal directly and applies this signal directly to the input of delay line 6.

Figure 4:
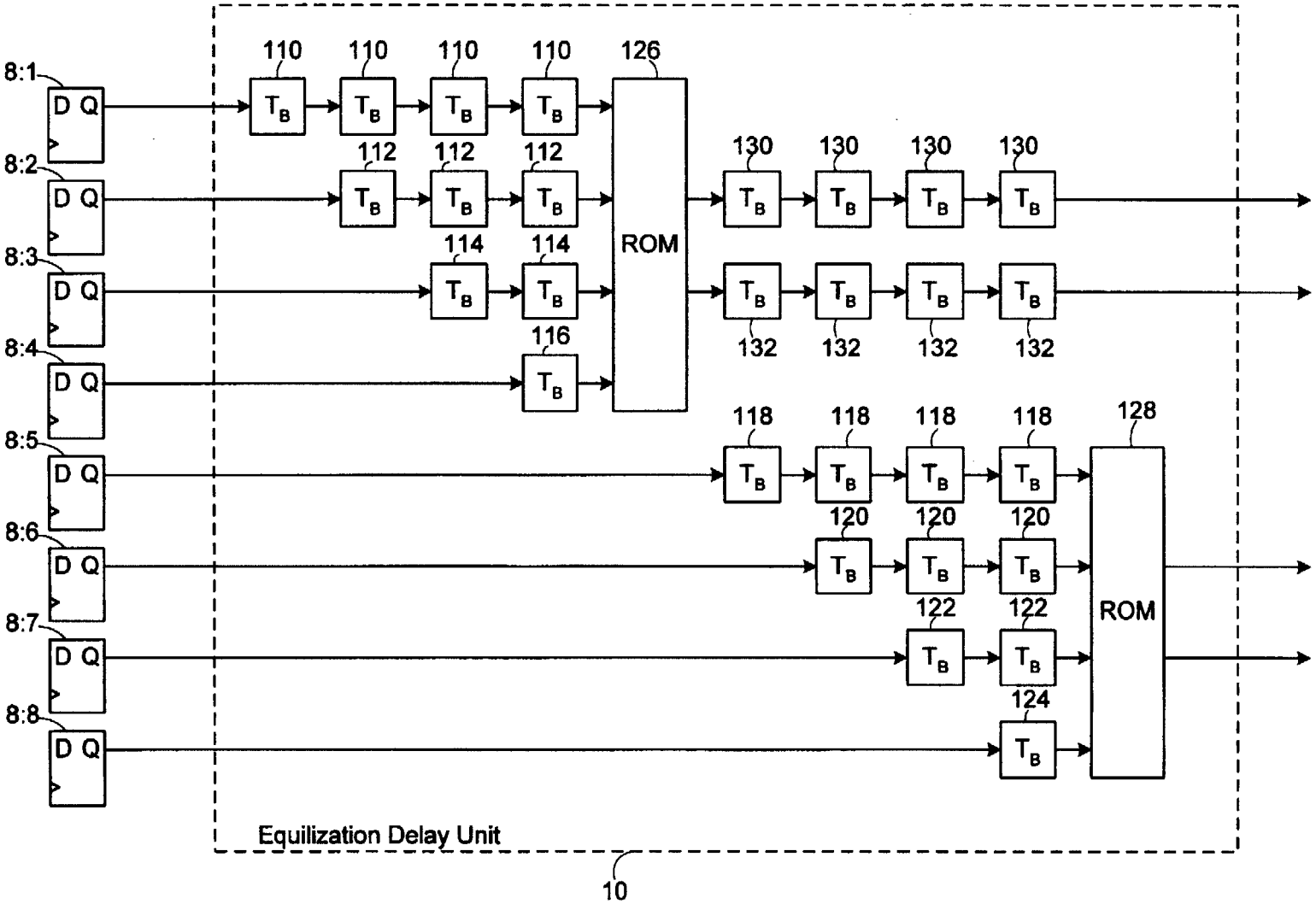
FIG. 4 shows an alternative embodiment, constructed according to the invention, of the equalization delay unit shown in FIG. 1.

FIG. 4 shows a block diagram of an alternative embodiment of equalization delay unit 10 constructed according to the invention. The particular unit 10 illustrated in FIG. 4 may be used with an interpolator 2 for which n is equal to eight (i.e., when interpolator 2 includes eight flip flops 8:1–8:8), however, those skilled in the art will appreciate that this illustrated embodiment is illustrative of a design of equalization delay unit 10 which may be used with interpolators having other sizes as well. The unit 10 shown in FIG. 4 receives eight input signals from the eight flip flops 8:1–8:n and generates therefrom four output signals representative thereof.

The output signal generated by flip flop 8:1 is applied to the first of a set of four serially cascaded delay elements 110; the output signal generated by flip flop 8:2 is applied to the first of a set of three serially cascaded delay elements 112; the output signal generated by flip flop 8:3 is applied to the first of a set of two serially cascaded delay elements 114; the output signal generated by flip flop 8:4 is applied to a delay element 116; the output signal generated by flip flop 8:5 is applied to the first of a set of four serially cascaded delay elements 118; the output signal generated by flip flop 8:6 is applied to the first of a set of three serially cascaded delay elements 120; the output signal generated by flip flop 8:7 is applied to the first of a set of two serially cascaded delay elements 122; and the output signal generated by flip flop 8:8 is applied to a delay element 124. Delay elements 110, 112, 114, 116 generate signals representative of the output signals generated by flip flops 8:1, 8:2, 8:3, 8:4, respectively, after being delayed by four, three, two, and one unit delays of length $T_B$, respectively, and apply these signals to a decoding circuit 126. Delay elements 118, 120, 122, 124 generate signals representative of the output signals generated by flip flops 8:5, 8:6, 8:7, 8:8, respectively, after being delayed by four, three, two, and one unit delays of length respectively, and apply these signals to a decoding circuit 128. Decoding circuit 126 generates two output signals, one of which is applied to a first of a set of four serially cascaded delay elements 130 and another of which is applied to a first of a set of four serially cascaded delay elements 132. Delay elements 130 generate one of the output signals of unit 10 and this output signal is representative of one of the signals generated by decoding circuit 126 after being delayed by four unit delays of length $T_B$. Similarly, delay elements 132 generates another of the output signals of unit 10 and this output signal is representative of the other of the signals generated by decoding circuit 126 after being delayed by four unit delays of length $T_B$. Decoding circuit 128 generates the remaining two output signals of unit 10.

The output signals generated by decoding circuits 126, 128 are representative of the input signals applied to the decoding circuits. Since for normal operation of interpolator 2 there is only a limited number of possible combinations of the output signals generated by flip flops 8:1–8:n, decoding circuits 126, 128 may generate output signals representative of the input signals applied to the decoding circuits even though the number of output signals is less than the number of input signals. So as those skilled in the art will appreciate, including the decoding circuits 126, 128 in equalization delay unit 10 reduces the number of delay elements used to implement unit 10. For example, since decoding circuit 126 uses two output signals to represent four input signals, inclusion of decoding circuit 126 reduces the number of delay elements used to implement unit 10 by eight. So in this embodiment of unit 10, inclusion of extra decoding circuitry results in a reduction of the number of delay elements used. Depending on the technology used to implement unit 10, such a tradeoff may be efficient and it may be desirable to include such decoding circuitry in unit 10.

In the illustrated embodiment, decoding circuits 126, 128, which may of course be implemented as look up tables or ROMs, are each used to generate two output signals which are representative of four input signals. As those skilled in the art will appreciate, in other embodiments other sizes of decoding circuits may be used (e.g., decoding circuits that receive eight or sixteen input signals) and the relationship between the number of input signals applied to a decoding circuit and the number of output signals generated by the decoding circuit may vary depending on the nature of the signals applied to interpolator 2.

Whereas specific embodiments of interpolator 2 have been discussed, those skilled in the art will appreciate that many variations of interpolator 2 are possible and are embraced within the scope of the invention. For example, in other embodiments of interpolator 2, it may be preferable to implement the delay lines 4, 6, and 10:1–10:n, using more than one type of delay element. For example, every other of the elements in delay line 4 could be implemented using transistor gate delay elements of the type described above, and the remaining elements could be implemented using other types of circuits having characteristic delays such as RC type circuits. In still other embodiments, the delay lines could be implemented using a stripline, a micro-stripline, a coaxial cable, or any other type of delay device. It may of course also be preferable to provide proper impedance terminations for the delay lines as is known in the art. Further, interpolator 2 has been discussed in connection with using a set of rising edge sensitive D type flip flops, however, those skilled in the art will appreciate that these flip flops could be replaced by other types of flip flops, or by any type of latch or register device. Still further, the delay elements of interpolator 2 have been described as all providing a unit delay of $T_A$ or $T_B$. Those skilled in the art will appreciate that insuring that the relative delay between corresponding signals $A_{(i+1)}$, $B_{(i+1)}$ and $A_i$, $B_i$ is always equal to $\Delta T$ (i.e., that the delay between $A_{(i+1)}$ and $A_i$ is $\Delta T$ longer than the delay between $B_{(i+1)}$ and $B_i$) provides a linear time measurement. However, it is not necessary for the delay of all the elements in delay line 4 to be equal to $T_A$ and for the delay of all the elements in delay line 6 to be equal to $T_B$ to provide a linear measurement. For example, if the delays provided by elements 4:1 and 4:2 equal $4\Delta T$ and $(4\Delta T+\delta x)$, respectively, and if the delays provided by elements 6:1 and 6:2 equal $3\Delta T$ and $(3\Delta T+\delta x)$, respectively, the relative delays between signals $A_2$ and $B_2$ and between $A_1$ and $B_2$, still equal $\Delta T$. So linearity may be preserved even with unequal delay elements in the same delay line. Still further, in some embodiments, linear time measurements may not be desired, and the relative delay between corresponding signals need not all be equal to $\Delta T$. As another example, interpolator 2 has been described as including ROM 12, however, those skilled in the art will appreciate that ROM 12 may be replaced with any type of known decoding circuitry, or alternatively, ROM 12 may be eliminated and the signals generated by equalization unit 10 may be taken as the output of interpolator 2.

The present embodiments are therefore to be considered in all respects as illustrative and not restrictive, the scope of the invention being indicated by the appended claims rather than by the foregoing description, and all changes which come within the meaning and band of equivalency of the claims are therefore intended to be embraced therein.

What is claimed is:

1. An apparatus for measuring a time interval between a first event and a second event, said apparatus comprising:

A. a first delay line having an input tap and a set of n output taps $F_1, F_2, \ldots F_n$, each of said output taps having an associated output delay interval, said input tap being coupled to receive a first signal representative of said first event, each of said output taps generating an output signal representative of said first signal after being delayed by its associated output delay interval;

B. a second delay line having an input tap and a set of n output taps $S_1, S_2, \ldots S_n$, each of said output taps having an associated output delay interval, said input tap being coupled to receive a second signal representative of said second event, each of said output taps generating an output signal representative of said second signal after being delayed by its associated output delay interval;

C. a set of n latch elements $L_1, L_2, \ldots L_n$, each of said latch elements having a first input terminal and a second input terminal, an ith one of said latch elements $L_i$ having its first input terminal coupled to receive the output signal generated at the ith output tap $F_i$ of said first delay line and its second input terminal coupled to receive the output signal generated at the ith output tap $S_i$ of said second delay line for all i from one to n, each of said latch elements including means responsive to one of the signals received at its first and second input terminals for latching the other of the signals received at its first and second input terminals and thereby generating a latch signal; and D. delay means for receiving the latch signals generated by all of said latch elements and including means for generating therefrom a delayed signal, said delayed signal being representative of respective ones of the latch signals generated by said latch elements as delayed by an associated delay interval, wherein the delay interval associated with the latch signal generated by the ith latch element $L_i$ is at least as large as a difference between the output delay intervals associated with the nth and ith output taps $S_n$ and $S_i$ of said second delay line for all i from one to n.

2. An apparatus according to claim 1, wherein the output delay interval associated with an ith output tap $F_i$ of said first delay line is substantially equal to the output delay interval associated with the nth output tap $F_n$ of said first delay line divided by n and multiplied by i for all i from one to n.

3. An apparatus according to claim 1, wherein the output delay interval associated with an ith output tap $S_i$ of said second delay line is substantially equal to the output delay interval associated with the nth output tap $S_n$ of said second delay line divided by n and multiplied by i for all i from one to n.

4. An apparatus according to claim 1, wherein a difference between the output delay intervals associated with any two output taps $F_i$ and $F_{(i-1)}$ of said first delay line for all i from two to n is substantially equal to a first unit delay, and wherein a difference between the output delay intervals associated with any two output taps $S_i$ and $S_{(i-1)}$ of said second delay line for all i from two to n is substantially equal to a second unit delay, the first unit delay being greater than the second unit delay.

5. An apparatus according to claim 1, wherein said second signal is an oscillatory clock signal characterized by a frequency $f_c$ and a corresponding period $T_c$.

6. An apparatus according to claim 1, further comprising frequency multiplier means for receiving an oscillatory clock signal characterized by a frequency $f_c$ and a corresponding period $T_c$ and for generating therefrom said second signal, said second signal being an oscillatory signal characterized by a frequency greater than $f_c$.

7. An apparatus according to claim 1, wherein said first delay line comprises a set of n delay elements F:1, F:2, . . . F:n, each of said delay elements including an input terminal and an output terminal and the output terminal of the ith delay element F:i being coupled to the input terminal of the next delay element F:(i+1) for all i from one to n minus 1.

8. An apparatus according to claim 7, wherein each of said delay elements comprises a bipolar transistor gate.

9. An apparatus according to claim 7 wherein each of said delay elements comprises a MOS transistor gate.

10. An apparatus according to claim 7, each of said delay elements further including a bias terminal.

11. An apparatus according to claim 10, wherein each of said delay elements has an associated propagation delay that is a function of a signal applied to its bias terminal, and each of said delay elements generates a signal at its output terminal representative of a signal applied to its input terminal after being delayed by its associated propagation delay.

12. An apparatus according to claim 11, wherein the bias terminals of all of said delay elements are coupled together.

13. An apparatus according to claim 1, wherein said delay means comprises a set of n delay units $D_1, D_2, \ldots D_n$, each of said delay units having an associated latch delay interval, the associated latch delay interval of an ith one of said delay units $D_i$ being at least as large as a difference between the output delay intervals associated with the nth and ith output taps $S_n$ and $S_i$ of said second delay line, said ith one of said delay units $D_i$ including means responsive to the latch signal generated by the ith one of said latch elements $L_i$ for generating therefrom a code signal representative of that latch signal after being delayed by its associated latch delay interval for all i from one to n.

14. An apparatus according to claim 13, further comprising decoder means for receiving the code signals generated by said set of n delay units and for generating therefrom a time stamp signal representative of a duration of the interval between said first and second events.

15. An apparatus according to claim 14, wherein said decoder means comprises a ROM.

16. An apparatus according to claim 13, wherein said second delay line comprises a set of n delay elements S:1, S:2, . . . S:n, each of said delay elements including an input terminal and an output terminal and the output terminal of the ith delay element S:i being coupled to the input terminal of the next delay element S:(i+1) for all i from one to n minus 1.

17. An apparatus according to claim 16, wherein each of said delay elements comprises a bipolar transistor gate.

18. An apparatus according to claim 16, each of said delay elements further including a bias terminal.

19. An apparatus according to claim 18, wherein each of said delay elements has an associated propagation delay that is a function of a signal applied to its bias terminal, and each of said delay elements generates a signal at its output terminal representative of a signal applied to its input terminal after being delayed by its associated propagation delay.

20. An apparatus according to claim 19, wherein the bias terminals of all of said delay elements are coupled together.

21. An apparatus according to claim 20, wherein each of said delay units comprises a set of delay elements including an input terminal, an output terminal, and a bias terminal.

22. An apparatus according to claim 21, wherein each of said delay elements in said delay units has an associated propagation delay that is a function of a signal applied to its bias terminal, and each of said delay elements in said delay units generates a signal at its output terminal representative of a signal applied to its input terminal after being delayed by its associated propagation delay.

23. An apparatus according to claim 21, wherein all of the bias terminals of said delay elements in said delay units are coupled together.

24. An apparatus according to claim 23, wherein all of the bias terminals of said delay elements in said delay units are coupled together with all of the bias terminals of said delay elements in said second delay line.

25. An apparatus according to claim 16, wherein an ith one of said delay units $D_i$ comprises a set of n minus i delay elements for all i from one to n.

26. An apparatus according to claim 25, wherein each of the delay elements in said delay units has an associated propagation delay and wherein the associated propagation delays of all of the delay elements in said delay units are substantially equal.

27. An apparatus according to claim 26, wherein each of the delay elements in said second delay line has an associated propagation delay and wherein the propagation delays of all of the delay elements in said second delay line are all substantially equal.

28. An apparatus according to claim 27, wherein the propagation delays of the delay elements in said second delay line are substantially equal to the propagation delays of the delay elements in said delay units.

29. An apparatus according to claim 1, wherein said delay means comprises a plurality of delay elements and at least one decoder means for receiving signals from said delay elements and for generating signals representative thereof.

30. An event time stamper for measuring a duration of an interval, comprising:

A. means for receiving a periodic clock signal characterized by an oscillation frequency $f_c$ and a corresponding period $T_c$ and including means for counting a number of periods $T_c$ of said clock signal occurring during said interval; and B. time interpolator means for measuring a duration of a remainder portion of said interval occurring during a fractional portion of a single period $T_c$ of said clock signal, comprising:

i. a first delay line having an input tap and a set of n output taps $F_1, F_2, \ldots F_n$, each of said output taps having an associated output delay interval, said input tap being coupled to receive a first signal representative of a beginning of said remainder portion, each of said output taps generating an output signal representative of said first signal after being delayed by its associated output delay interval;

ii. a second delay line having an input tap and a set of n output taps $S_1, S_2, \ldots S_n$, each of said output taps having an associated output delay interval, said input tap being coupled to receive a second signal representative of an ending of said remainder portion, each of said output taps generating an output signal representative of said second signal after being delayed by its associated output delay interval;

iii. a set of n latch elements $L_1, L_2, \ldots L_n$, each of said latch elements having a first input terminal and a second input terminal, an ith one of said latch elements $L_i$ having its first input terminal coupled to receive the output signal generated at the ith output tap $F_i$ of said first delay line and its second input terminal coupled to receive the output signal generated at the ith output tap $S_i$ of said second delay line for all i from one to n, each of said latch element including means responsive to one of the signals received at its first and second input terminals for latching the other of the signals received at its first and second inputs and thereby generating a latch signal; and iv. delay means for receiving the latch signals generated by all of said latch elements and including means for generating therefrom a delayed signal, said delayed signal being representative of respective ones of the latch signals generated by said latch elements as delayed by an associated delay interval, wherein the delay interval associated with the latch signal generated by the ith latch element $L_i$ is at least as large as a difference between the output delay intervals associated with the nth and ith output taps $S_n$ and $S_i$ of said second delay line for all i from one to n.

* * * * *